US008914915B1

(12) United States Patent
Alari et al.

(10) Patent No.: US 8,914,915 B1
(45) Date of Patent: Dec. 23, 2014

(54) DECORATIVE FOOTWEAR SYSTEM

(71) Applicants: Lisa Alari, Boca Raton, FL (US); Chris Hunter, Boca Raton, FL (US); Wilma Bivin-Hunter, Boca Raton, FL (US)

(72) Inventors: Lisa Alari, Boca Raton, FL (US); Chris Hunter, Boca Raton, FL (US); Wilma Bivin-Hunter, Boca Raton, FL (US)

( * ) Notice: Subject to any disclaimer, the term of this patent is extended or adjusted under 35 U.S.C. 154(b) by 0 days.

(21) Appl. No.: 14/189,491

(22) Filed: Feb. 25, 2014

Related U.S. Application Data

(60) Provisional application No. 61/909,104, filed on Nov. 26, 2013.

(51) Int. Cl.
*A43B 23/24* (2006.01)

(52) U.S. Cl.
CPC ..... *A43B 23/24* (2013.01)
USPC ..... 2/245

(58) Field of Classification Search
USPC ..... 2/245, 243.1, 246, 449, 250; 36/70 R, 36/136
See application file for complete search history.

(56) References Cited

U.S. PATENT DOCUMENTS

| | | | | |
|---|---|---|---|---|
| 1,738,605 | A | 12/1929 | Myers et al. | |
| 2,464,859 | A * | 3/1949 | Gilowitz | 2/245 |
| 4,431,701 | A | 2/1984 | Hamada et al. | |
| 5,673,499 | A | 10/1997 | Attilieni | |
| 5,857,220 | A * | 1/1999 | Erny et al. | 2/244 |
| 5,989,683 | A | 11/1999 | Haddock et al. | |
| 6,412,151 | B1 | 7/2002 | Rowland | |
| 6,601,323 | B2 * | 8/2003 | Tsujino et al. | 36/136 |
| 7,000,337 | B2 * | 2/2006 | Harrington | 36/132 |
| 7,237,347 | B2 * | 7/2007 | Tobias | 36/112 |
| 7,698,836 | B2 * | 4/2010 | Schmelzer et al. | 36/136 |
| 2007/0006426 | A1 | 1/2007 | Fukuyasu et al. | |
| 2010/0011623 | A1 | 1/2010 | Seckler et al. | |
| 2010/0047604 | A1 | 2/2010 | Stratton-Metzger | |
| 2011/0225851 | A1 | 9/2011 | Nelson | |
| 2013/0174382 | A1 | 7/2013 | Martinson | |

FOREIGN PATENT DOCUMENTS

| | | |
|---|---|---|
| EP | 1006164 A1 | 6/2000 |
| EP | 1580139 A1 | 9/2005 |

* cited by examiner

*Primary Examiner* — Tejash Patel
(74) *Attorney, Agent, or Firm* — Robert C. Montgomery; Montgomery Patent & Design

(57) ABSTRACT

A decorative footwear adornment providing a removable and reusable ornamentation for use upon existing footwear includes an attachable base plate being embellished with a decorative element or indicia. The base plate includes extending malleable attachment arms, each encased within a flexible polymer material, which are wrapped around and secured to straps or other portions of the footwear. The flexible nature of the attachment arms enables a user to repeatedly interchange and reuse the adornments with various footwear.

13 Claims, 7 Drawing Sheets

DECORATIVE FOOTWEAR SYSTEM

RELATED APPLICATIONS

The present invention was first described in and claims the benefit of U.S. Provisional Application No. 61/909,104, filed Nov. 26, 2013, the entire disclosures of which are incorporated herein by reference.

FIELD OF THE INVENTION

The present invention relates generally to a decorative footwear ornament or adornment for use upon existing footwear.

BACKGROUND OF THE INVENTION

Modern fashion trends dictate an ever evolving and changing of popularity wherein the clothing, shoes, and fashion accessories that are considered cutting edge today are considered passé tomorrow. In keeping with these trends, society has a strong desire to be different, and is willing to be judged by the fashions that one wears. Thus, the fashion industry is in a constant search for new and innovative styles and solutions that will help to define the next fashion trend. Not limited strictly to clothing, this need for innovation extends to all areas of fashion, including that of accessories, such as shoes and sandals. Accordingly, there is a constant need for new and innovative ideas that not only create new fashion styles, but also innovates the fashion industry.

SUMMARY OF THE INVENTION

The disadvantages of the prior art are overcome by the present invention in providing a decorative footwear adornment having an attachable base plate with a plurality of attachment arms, each extending outwardly from a perimeter edge of the base plate. A decorative element is affixed to a first side of the base plate with the second side juxtaposed to an outer surface of an individual item of footwear so that the decorative element is viewable to an observer. The plurality of attachment arms allows a wearer to removably attach the adornment to the item of footwear.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
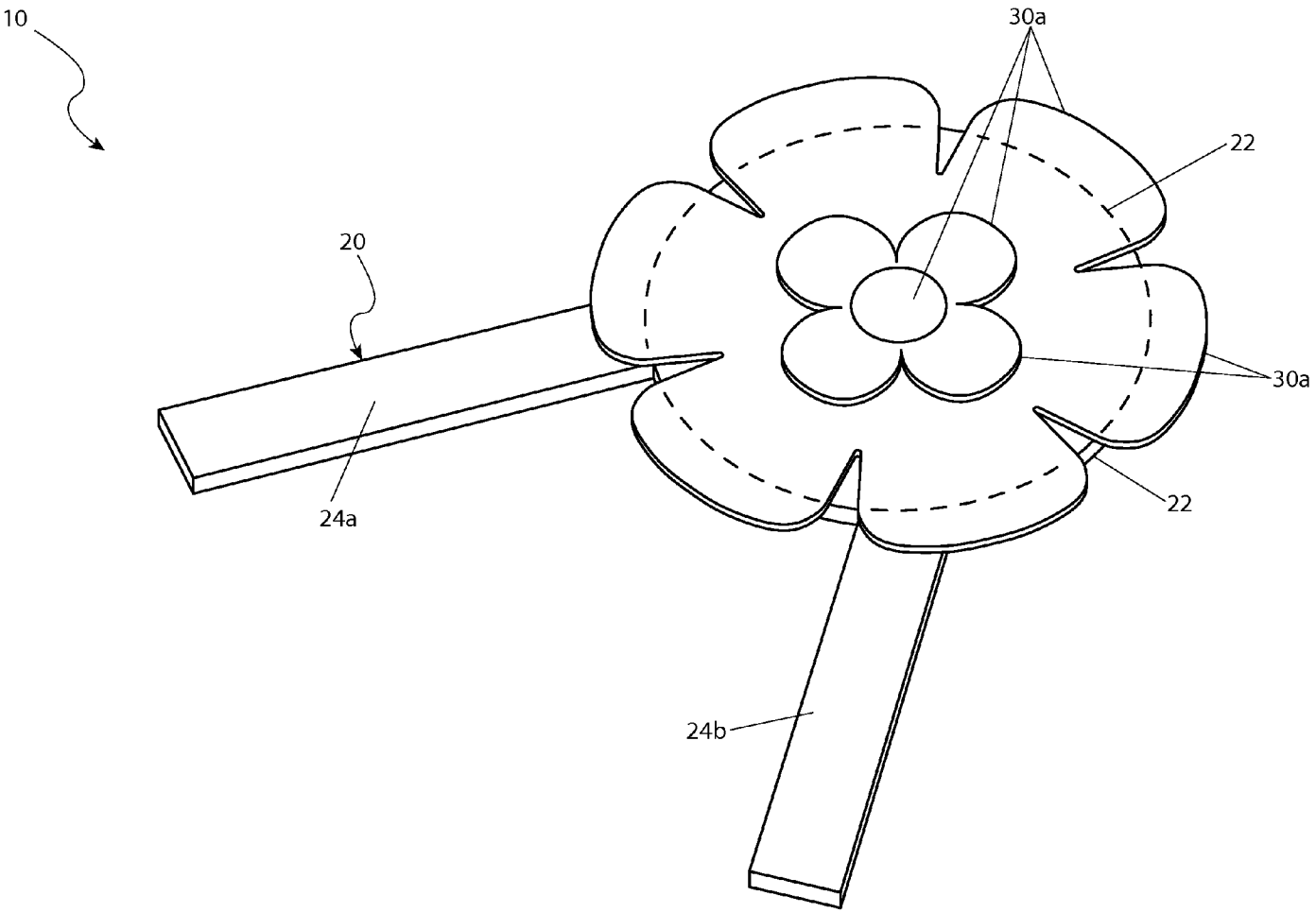
FIG. 1 is a top perspective view of a decorative footwear adornment 10, according to a preferred embodiment of the present invention.

10 decorative footwear adornment
20 base plate
21 cover
22 base plate upper surface
24*a* first attachment arm
24*b* second attachment arm
26 bend
30*a* first decorative element
30*b* second decorative element
30*c* third decorative element
30*d* fourth decorative element
30*e* fifth decorative element
40 adhesive layer
100 footwear
105 strap

DETAILED DESCRIPTION OF THE PREFERRED EMBODIMENT

Figure 3:
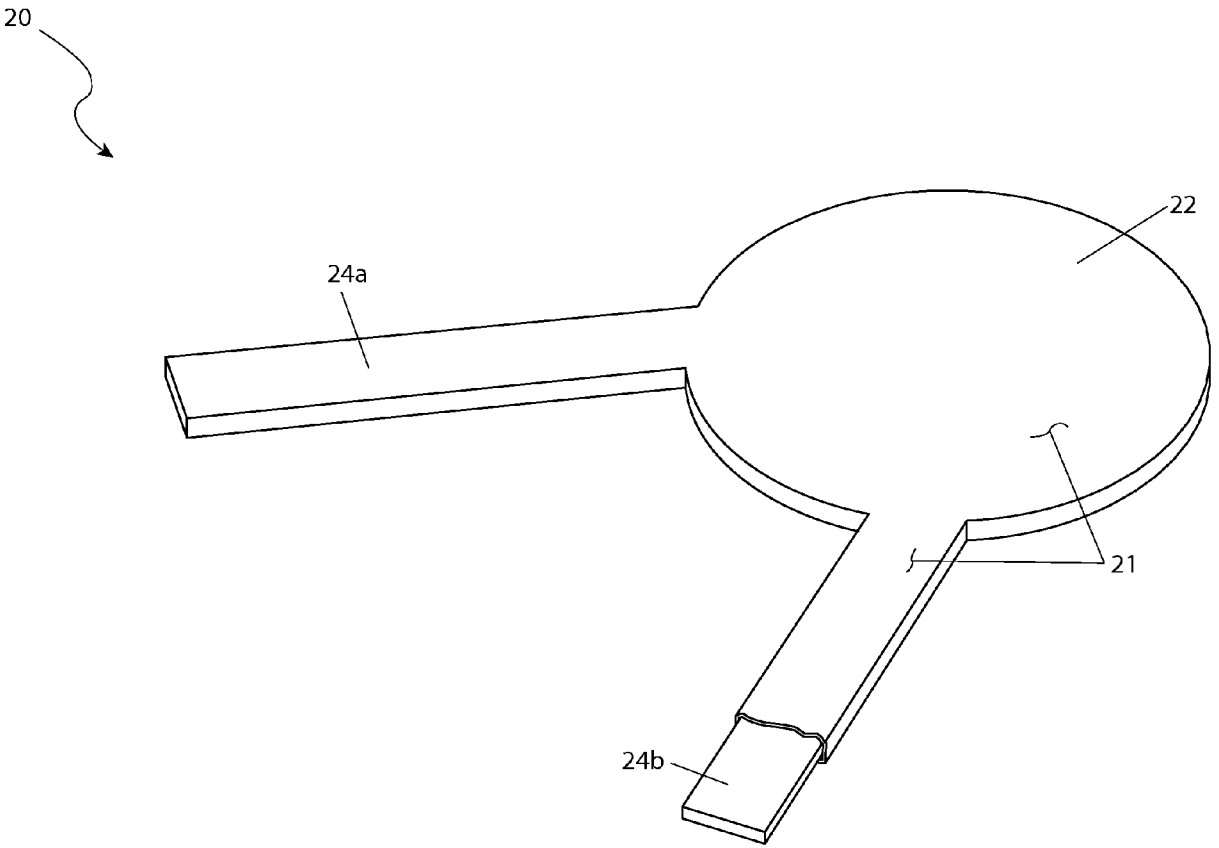
FIG. 3 is a close-up perspective view of a base plate portion 20 of the decorative footwear adornment 10, according to a preferred embodiment of the present invention.
Figure 4:
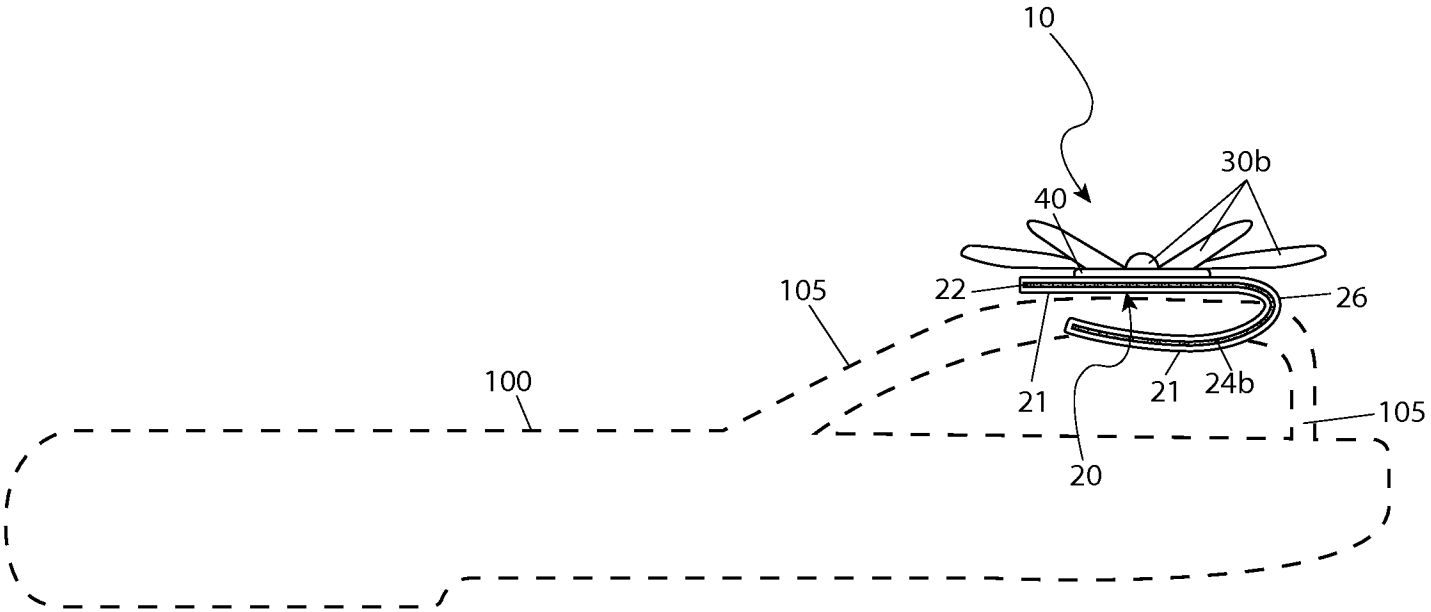
FIG. 4 is a section view of the decorative footwear adornment 10 being mounted to a footwear 100 taken along section line A-A (see FIG. 2), according to a preferred embodiment of the present invention.
Figure 5A:
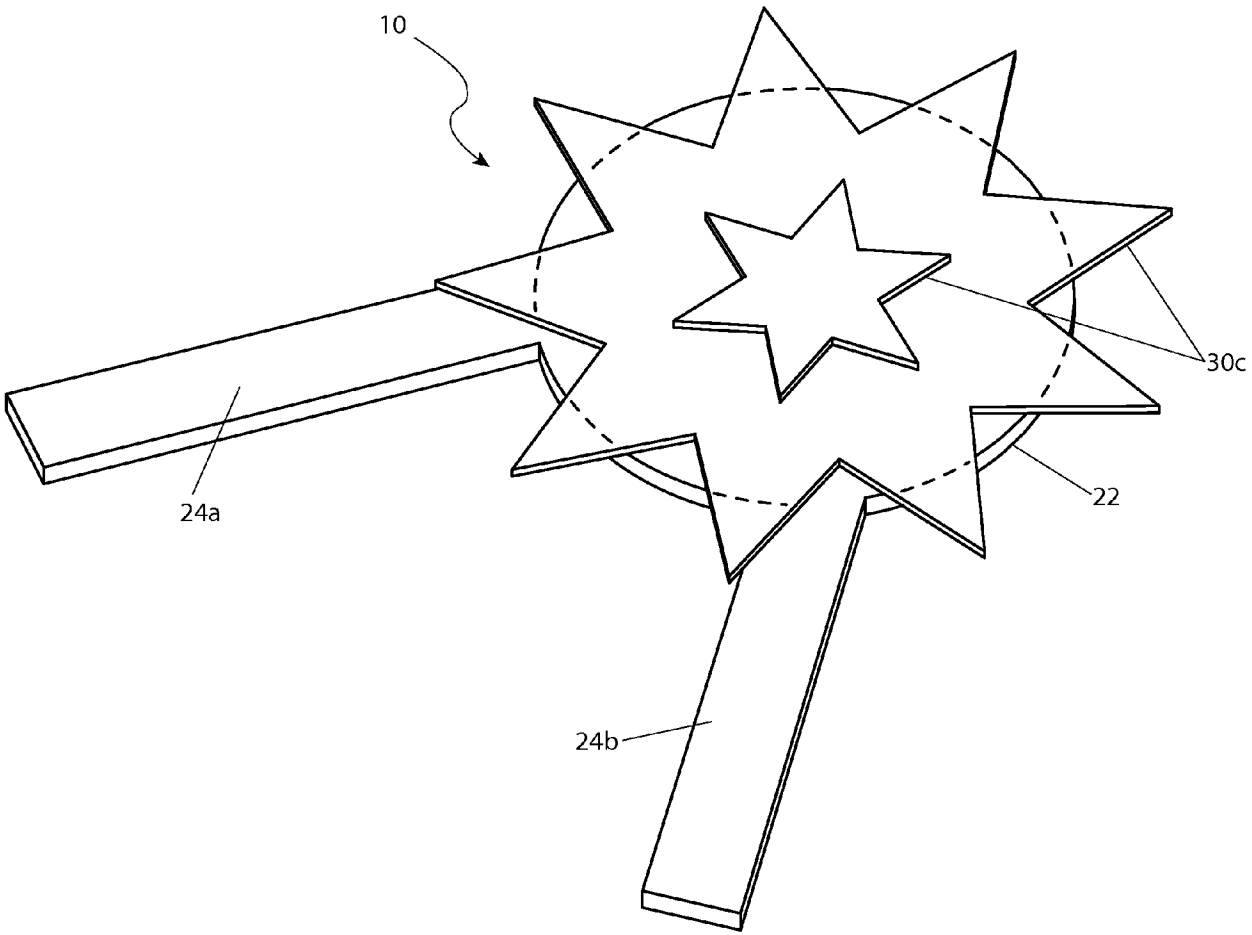
FIG. 5*a* is a perspective view of the decorative footwear adornment 10 depicting a third decorative member 30*c* affixed thereto.
Figure 5B:
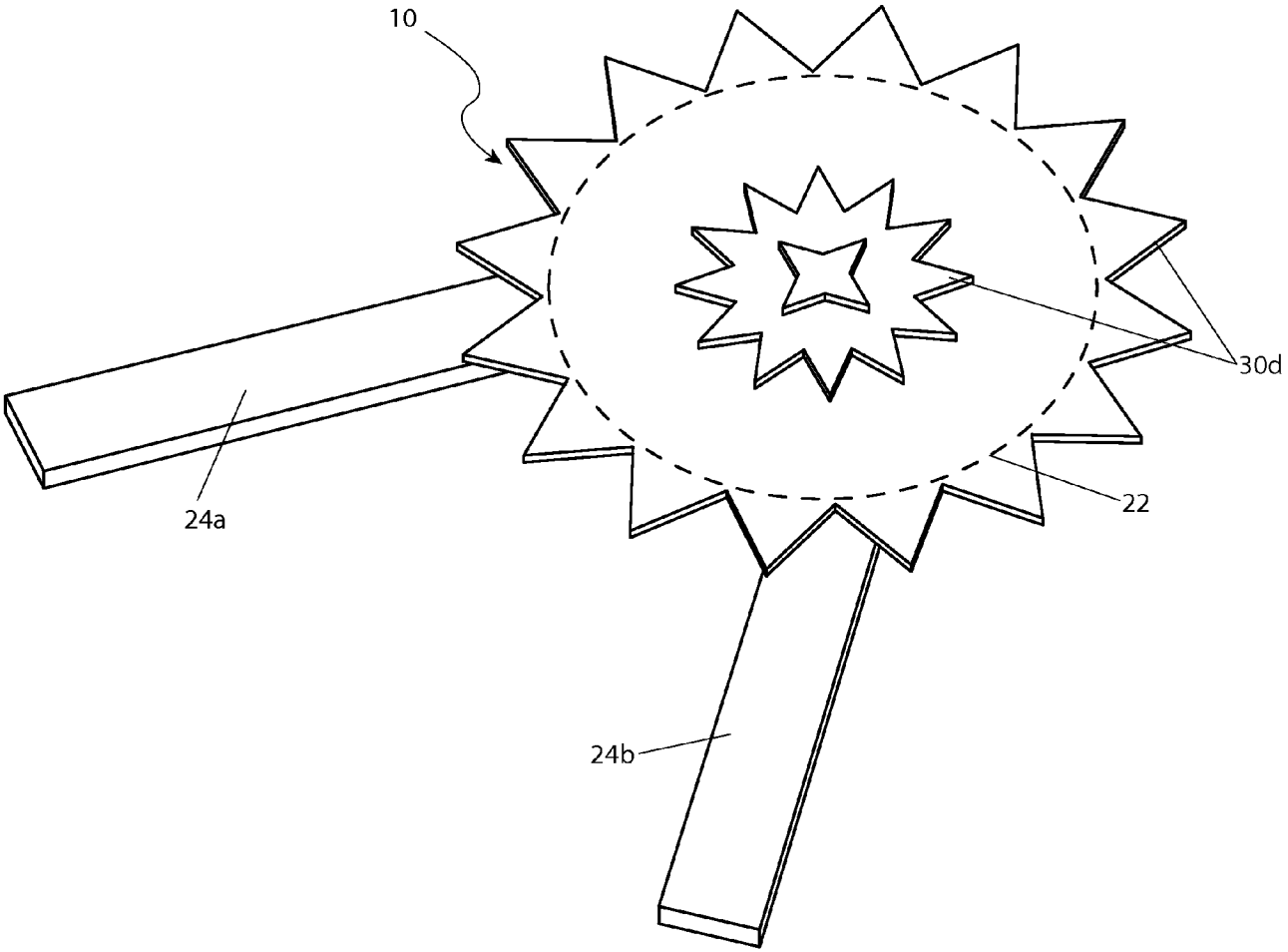
FIG. 5*b* is another perspective view of the decorative footwear adornment 10 depicting a fourth decorative member 30*d* affixed thereto; and, FIG. 5*c* is yet another perspective view of the decorative footwear adornment 10 depicting a fifth decorative member 30*e* affixed thereto.
Figure 5C:
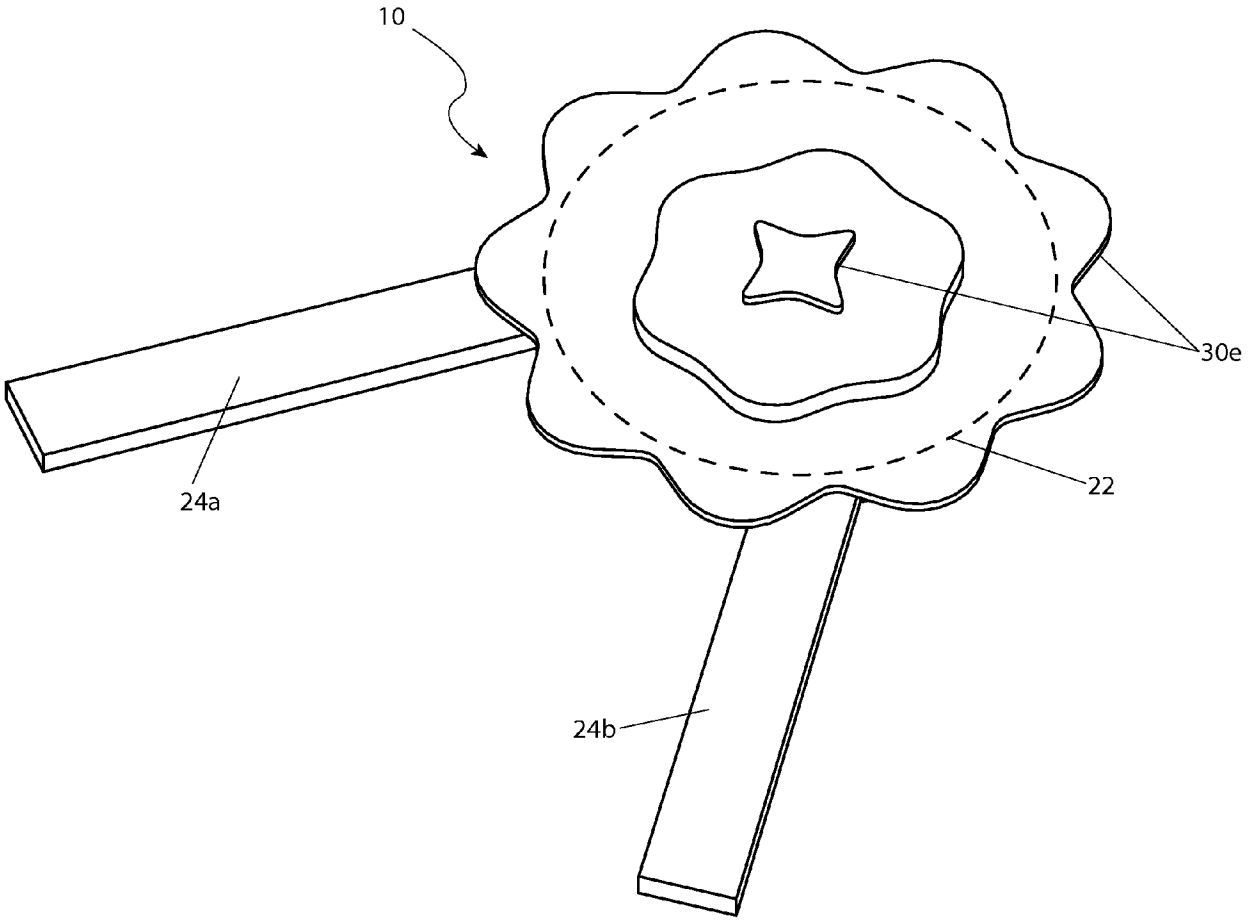

The best mode for carrying out the invention is presented in terms of its preferred embodiment, herein depicted within FIGS. 1 through 4, and in terms of alternate embodiments herein depicted within FIGS. 5*a*, 5*b*, and 5*c*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
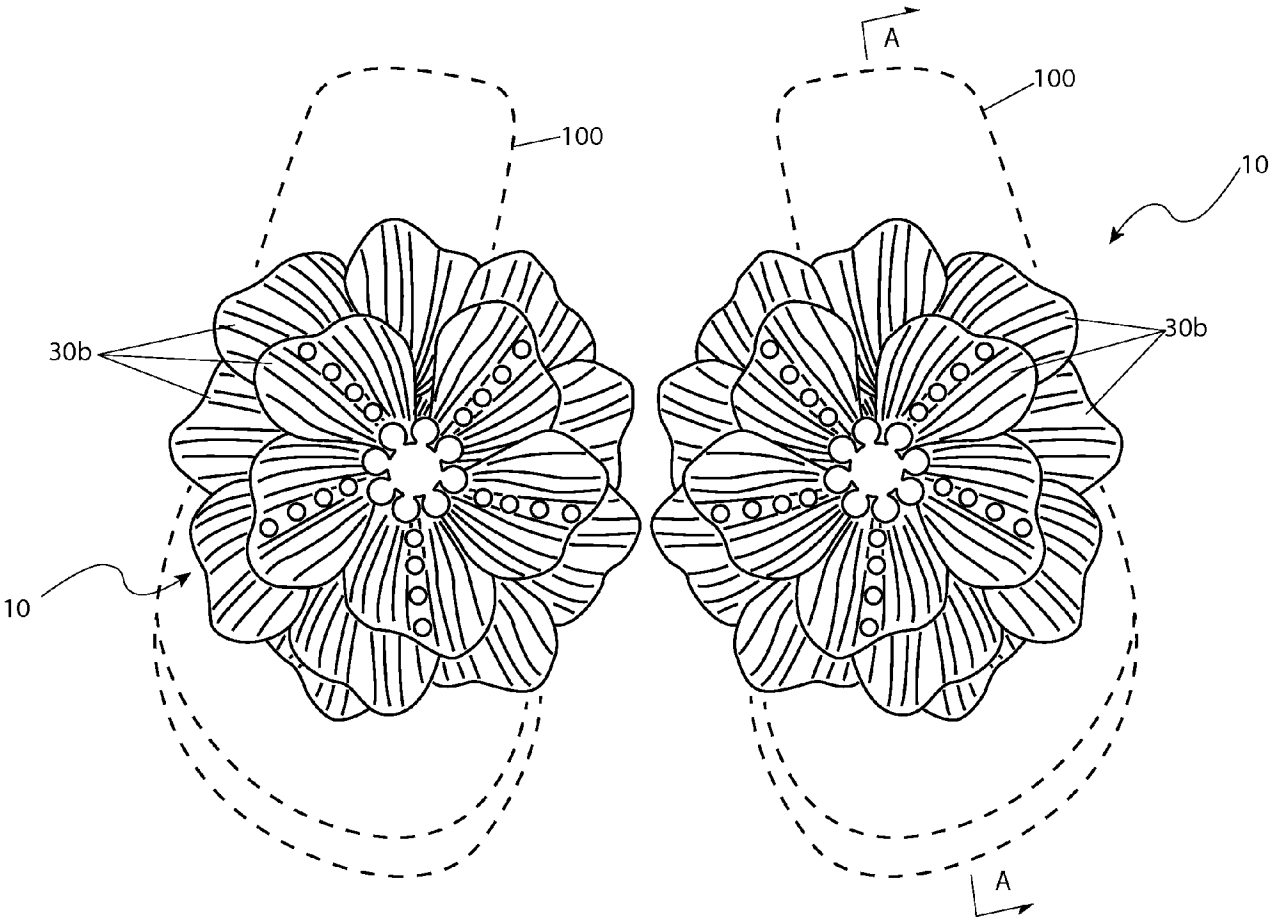
FIG. 2 is an environmental view of the decorative footwear adornment 10, according to a preferred embodiment of the present invention.

The present invention describes a decorative footwear adornment (herein described as the "adornment") 10, which provides various decorative and ornamental novelty attachments for use upon footwear 100, preferably open style shoes such as sandals, flip-flops, and the like. Referring now to FIGS. 1 and 2, top perspective and environmental views of the adornment 10, according to a preferred embodiment of the present invention, are disclosed. Embodiments of the adornment 10 are shown in FIG. 1 including of a first decorative element 30*a*, and in FIG. 2, including of an attached second decorative element 30*b*. Other embodiments of the adornment 10 are envisioned providing a series of decorative elements 30*b*, 30*c*, 30*d*, 30*e*, such as flowers, medallions, pompoms, costume jewels, feathers, buttons, printed logos, or the like. The adornment 10 includes a base plate 20 onto which the first decorative element 30*a* is affixed. Furthermore, the base plate 20 includes a plurality of attachment means which extend outwardly from a perimeter edge of the base plate 20. In the preferred embodiment, the plurality of attachment means are envisioned as a pair of attachment arms 24*a*, 24*b* that are, in use, bent downwardly, then wrapped back under and around a portion of the item of footwear 100 to secure the adornment 10. Typically, the footwear 100 is of a style that includes strap portions 105, as illustrated in FIG. 4, such that the attachment arms 24*a*, 24*b* are bent under the strap portions 105 to secure the adornment 10. It should be appreciated however, that the attachment arms 24*a*, 24*b* are capable of repeated bending and reuse upon multiple items of footwear 100, providing for a quick change of the adornment 10 between different styles of footwear 100 such as sandals, flip-flops, and may even be attached to shoelace areas of shoes and boots. Furthermore, it is envisioned that the adornment 10 may be attached with similar ease and effect to other suitable appendages upon one's person such as, but not limited to: clothing straps, waist belts, handbags, and the like, to provide a decorative accent, and as such should not be interpreted as a limiting factor of the adornment 10.

Referring now to FIG. 3, a perspective view of a base plate portion 20 of the adornment 10, according to a preferred embodiment of the present invention, is disclosed. The base plate 20 provides a unitary member coated or encased within a flexible polymer cover 21 made of a material such as vinyl or silicone. A particular embodiment of the base plate 20 is illustrated here having a circular first side or upper surface 22, a first attachment arm 24*a*, and a second attachment arm 24*b*. The attachment arms 24*a*, 24*b* are shown here in close proximity to each other along a perimeter edge of the base plate upper surface 22, and protruding outwardly in a diverging manner; however, as previously mentioned the base plate 20 may include a plurality attachment arms 24*a*, 24*b* which may be arranged at various locations around the base plate upper surface 22 at various extending angles without deviating from the teachings of the adornment 10, and as such should not be interpreted as a limiting factor of the invention. Additionally, the attachment arms 24*a*, 24*b* may not be integral to the base plate 20 and may be formed individually and then affixed to the bottom or second side of the base plate. The base plate 20 is envisioned being made using a flexible metal material such as a copper alloy, a lead alloy, or equivalent, allowing the attachment arms portions 24*a*, 24*b* to withstand repeated bending 26, attachment, and reuse upon multiple footwear 100 without failure.

Referring now to FIG. 4, a section view of the adornment 10 being mounted to a footwear 100, taken along section line A-A (see FIG. 2), according to a preferred embodiment of the present invention, is disclosed. The adornment 10 is illustrated here being applied to an open-toe style of footwear 100. The adornment 10 is retained in position along a top surface portion of the straps 105 by manipulating the arms and applying a downward bend 26 of approximately one-hundred eighty)(180° degrees to each attachment arms 24*a*, 24*b* with the attachment arms 24*a*, 24*b* being wrapped through and/or around the straps 105.

A second decorative element 30*b* is shown here being adhesively bonded to the base plate upper surface 22 preferably using a common adhesive such as hot-melt glue, epoxy, or the like. It is further envisioned that the decorative elements 30*a*, 30*b*, 30*c*, 30*d*, 30*e* may utilize other methods of attachment to the base plate upper surface 22 such as rivets, snaps, soldering, or the like, and as such should not be interpreted as a limiting factor of the adornment 10.

Referring now to FIGS. 5*a*, 5*b*, and 5*c*, perspective views of the adornment 10 depicting various configurations including a third decorative element 30*c*, a fourth decorative element 30*d*, and a fifth decorative element 30*e*, respectively, are disclosed. Various decorative elements 30*a*, 30*b*, 30*c*, 30*d*, 30*e* may be incorporated into the adornment 10 to provide a visual representation of various items such as flowers, medallions, pom-poms, costume jewels, feathers, buttons, or the like. These decorative elements may be comprised of, and are not limited to, textile, metal, plastics, or other natural components. Additionally, rather than a decorative element, the base plate upper surface 22 may simply have indicia printed or otherwise applied to it. This embodiment would include printed logos, slogans, advertising, pictures, other writings, or some combination thereof. It is envisioned that the adornment 10 may be introduced for sale in individual units or in sets having various quantities and designs of decorative elements 30*a*, 30*b*, 30*c*, 30*d*, 30*e* based upon a user's preferences. It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the adornment 10, it would be installed as indicated in FIGS. 2 and 4. The method of installing and utilizing the adornment 10 may be achieved by performing the following steps: procuring the adornment 10 in a form of a single unit or as a set of units having decorative elements 30*a*, 30*b*, 30*c*, 30*d*, 30*e* which include desired designs, colors, and the like; selecting an existing footwear 100 onto which to apply the adornment 10, preferably being an open-toe style footwear 100; placing the base plate upper surface 22 of the base plate 20 upon a top surface of the straps 105 of the footwear 100; forming a bend 26 in the first attachment arm 24*a* in a downward direction and through or around at least one (1) strap 105 of the footwear 100; repeating the bending 26 and wrapping steps for the remaining second attachment arm 24*b* in like manner; repeating the previous installation steps for a remaining footwear portion 100; donning, wearing, and walking using the footwear 100 equipped with the decorative adornment 10; removing the adornment 10 from the footwear 100 for use upon different footwear 100, or to install another unit of the adornment 10 thereupon by partially or completely straightening the bend 26 in the attachment means 24*a*, 24*b*; lifting and removing the adornment 10 from the footwear 100; straightening the attachment arms 24*a*, 24*b* in a coplanar manner for compact storage in a drawer, purse, or the like, until needed again; and, benefiting from an attractive, versatile, portable, and quickly installed means to decorate one's footwear 100 afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A decorative adornment comprising:

a base plate;

a plurality of attachment arms, each extending outwardly from a perimeter edge of said base plate; and, a decorative element affixed to a first side of said base plate;

wherein a second side of said base plate is adaptably juxtaposed to an outer surface of an individual item of footwear such that said decorative element is viewable to an observer;

wherein said plurality of attachment arms removably attach said adornment to said item of footwear; and, wherein said decorative element further comprises a plurality of individual decorative elements disposed one upon the other in a stacking manner.

2. The attachment of claim 1, wherein said plurality of said attachment arms are flexible to allow said attachment arms to be manipulated about a portion of said item of footwear to secure said adornment thereto.

3. The attachment of claim 2, wherein said plurality of said attachment arms remain flexible in response to repeated bending to allow said adornment to be reused.

4. The attachment of claim 1, wherein said decorative element further comprises a plurality of individual decorative elements juxtaposed to one another about said first side of said base plate.

5. The attachment of claim 2, wherein said base plate is encased within a flexible polymer cover.

6. The attachment of claim 1, wherein said decorative element comprises a plurality of textile elements arranged to provide a visual representation of a flower.

7. A decorative adornment comprising:

a base plate having indicia disposed on a first side; and, a plurality of attachment arms, each extending outwardly from a perimeter edge of said base plate;

wherein said base plate is adaptably placed on an outer surface of an item of footwear such that said indicia is viewable to an observer; and wherein said plurality of attachment arms removably attach said adornment to said item of footwear;

wherein said base plate is encased within a flexible polymer cover.

8. The attachment of claim 7, wherein said plurality of said attachment arms are flexible to allow said attachment arms to be manipulated about a portion of said item of footwear to secure said adornment thereto.

9. The attachment of claim 8, wherein said plurality of said attachment arms remain flexible in response to repeated bending to allow said adornment to be reused.

10. A decorative adornment comprising:

a base plate;

a plurality of decorative elements affixed to a first side of said base plate; and, a plurality of flexible attachment arms, each said arm attached to a second side of said base plate and extending outwardly from a perimeter edge of said base plate;

wherein a second side of said base plate is adaptably juxtaposed to an outer surface of an item of footwear such that said decorative element is viewable to an observer; and, wherein each of said plurality of attachment arms are individually manipulated by a user to a position underneath said base plate to entrap and be retained by portions of said item of footwear;

wherein said plurality of decorative elements further comprise individual elements disposed one upon the other in a stacking manner.

11. The attachment of claim 1, wherein said plurality of decorative elements further comprise individual elements that are juxtaposed to one another about said first side of said base plate.

12. The attachment of claim 2, wherein said base plate is encased within a flexible polymer cover.

13. The attachment of claim 1, wherein said decorative element comprises a plurality of textile elements arranged to provide a visual representation of a flower.

* * * * *